United States Patent [19]

Kojima et al.

[11] 4,361,797

[45] Nov. 30, 1982

[54] CONSTANT CURRENT CIRCUIT

[75] Inventors: Yoshikazu Kojima; Masaaki Kamiya, both of Tokyo, Japan

[73] Assignee: Kabushiki Kaisha Daini Seikosha, Japan

[21] Appl. No.: 231,799

[22] Filed: Feb. 5, 1981

[30] Foreign Application Priority Data

Feb. 28, 1980 [JP] Japan ..... 55-24521

[51] Int. Cl.[3] ..... G05F 3/20

[52] U.S. Cl. ..... 323/316; 307/297; 307/304; 330/288

[58] Field of Search ..... 323/312–317; 330/253, 257, 277, 288, 296, 297; 307/296 R, 297, 304, 313

[56] References Cited

U.S. PATENT DOCUMENTS

| | | | |
|---|---|---|---|
| 3,832,644 | 8/1974 | Nagata et al. | 323/313 X |
| 3,875,430 | 4/1975 | Prak | 307/304 X |
| 3,887,881 | 6/1975 | Hoffmann | 330/277 |
| 4,011,471 | 3/1977 | Rockett, Jr. | 323/313 X |
| 4,264,874 | 4/1981 | Young | 330/277 |

*Primary Examiner*—William M. Shoop

*Assistant Examiner*—Peter S. Wong

*Attorney, Agent, or Firm*—Robert E. Burns; Emmanuel J. Lobato; Bruce L. Adams

[57] ABSTRACT

A constant current circuit comprising first and second insulated gate field effect transistors connected in series, and third and fourth insulated gate field effect transistors connected in series. The series connected transistor pairs are connected in parallel. The first and third transistors have different threshold voltages, and have their respective gate electrodes connected together, and the second and fourth transistors have equal threshold voltages and have their respective gate electrodes connected together. The gate of the second transistor is connected to the node between the first and second transistors, and the gate of the third transistor is connected to the node between the third and fourth transistors. A fifth insulated gate field effect transistor has a gate electrode connected to a respective one of the nodes so as to flow therethrough a substantially constant current when a supply voltage is applied across the pair of parallel connected series transistor pairs and the fifth transistor is connected in parallel with the supply voltage.

8 Claims, 6 Drawing Figures

CONSTANT CURRENT CIRCUIT

BACKGROUND OF THE INVENTION

The present invention relates to a constant current circuit for supplying a constant current to a power source.

A conventional constant current circuit is illustrated in FIG. 1. The operation principle will be hereinafter described in conjunction with FIG. 1. When the current flowing through a load 1 is represented by $I_{ref}$, a voltage $V_r$ produced across a resistor 3 having a resistance value of R is expressed by the following equation.

$$V_R = R.I_{ref1} \quad (1)$$

The voltage $V_R$ produced across the resistor 3 represented by the equation (1) is compared with the output voltage $V_{ref}$ of a constant voltage circuit 5 in a comparator 4 as illustrated in FIG. 1, and a constant current insulated gate field effect transistor 2 is driven by the output therefrom. In this case, the transistor 2 is turned on when $V_{ref}$ is larger than $V_R$ and is turned off when $V_{ref}$ is smaller than $V_R$. That is, the constant current insultated gate field effect transistor is operated in such a way that $V_R$ is equal to $V_{ref}$. Therefore, the constant current $I_{ref1}$ produced by the constant current circuit as illustrated in FIG. 1 will be expressed as follows.

$$I_{ref1} = V_{ref}/R \quad (2)$$

As clearly understood from the equation (2), the conventional constant current circuit has the following disadvantages.

1. Since the comparator and the constant voltage circuit 5 are required, the circuit is complex and cannot be operated with less power.

2. The resistor 3 cannot be fabricated with less dispersion by the present integrated circuit technique so that the circuit is not suitable for integrated circuit.

An object of the present invention is to provide a constant current circuit, in which the defects in the prior art are removed, the dispersion of the constant current $I_{ref1}$ is smaller, and the number of the elements is reduced so as to easily fabricate as an integrated circuit.

DETAILED DESCRIPTION OF THE INVENTION

Figure 1:
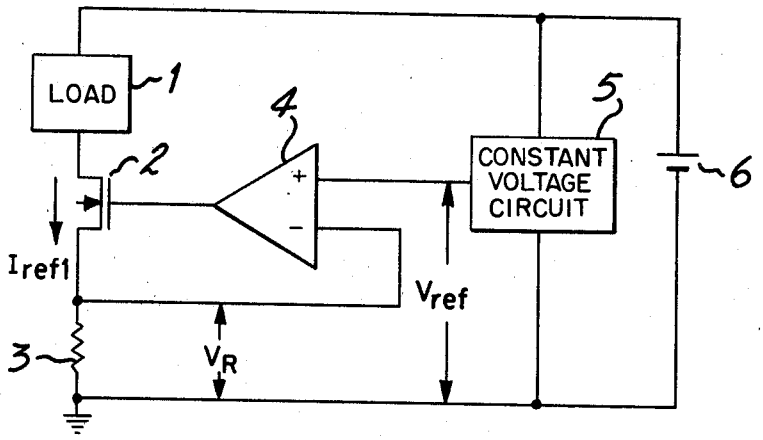
FIG. 1 is a circuit diagram of a conventional constant current circuit.

The present invention will be described in more detail in conjunction with FIG. 2.

When conductance constants of insulated gate field effect transistors(IGFET) 8 and 10 are $K_{P1}$ and $K_{N1}$, respectively, and threshold voltages thereof are $V_{TP1}$ and $V_{TN}$, the current $I_1$ flowing through the IGFET 8 and the IGFET 10 is expressed by the equation (3). However, the assumption is made that all of the IGFETs are operated in the saturation region and are not operated in the sub-threshold region, in order to simplify the explanation.

$$I_1 = \frac{K_{P1}}{2}(V_{GP} - V_{TP1})^2 = \frac{K_{N1}}{2}(V_{GN} - V_{TN})^2 \quad (3)$$

In the equation (3), $V_{GP}$ represents each gate voltage of the IGFETs 8 and 9, respectively, and $V_{GN}$ represents each gate voltage of the IGFETs 10 and 11.

By the similar way, the current $I_2$ flowing through the IGFETs 9 and 11 will be expressed as the following equation (4) when the conductance constants of the IGFETs 9 and 11 are $K_{P2}$ and $K_{N2}$, respectively and the threshold voltages thereof are $V_{TP2}$ and $V_{TN}$, respectively.

$$I_2 = \frac{K_{P2}}{2}(V_{GP} - V_{TP2})^2 = \frac{K_{N2}}{2}(V_{GN} - V_{TN})^2 \quad (4)$$

$V_{GN}$ and $V_{GP}$ will be obtained from the equations (3) and (4) as follows.

$$V_{GN} = V_{TN} + C_1(V_{TP1} - V_{TP2}) \quad (5)$$

$$V_{GP} = V_{TP2} + C_2(V_{TP1} - V_{TP2}) \quad (6)$$

Wherein, the $C_1$ and $C_2$ are constants which can be obtained from the calculation based on each conductance constant of the IGFETs and they are expressed by the following equations, respectively.

$$C_1 = \left(1 - \sqrt{\frac{K_{P2}}{K_{P1}} \cdot \frac{K_{N1}}{K_{N2}}}\right)^{-1} \quad (7)$$

$$C_2 = \sqrt{\frac{K_{P2}}{K_{N2}}}\left(1 - \sqrt{\frac{K_{P2}}{K_{P1}} \cdot \frac{K_{N1}}{K_{N2}}}\right)^{-1} \quad (8)$$

Figure 2:
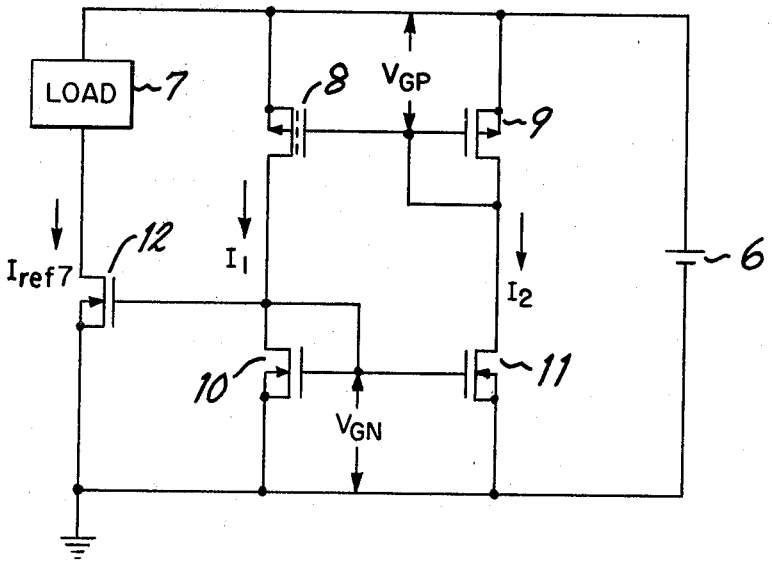
FIG. 2, FIG. 4, FIG. 5 and FIG. 6 are circuit diagrams of constant current circuits of the present invention.

Therefore, when the voltage expressed by the equation (5) is applied to the gate electrode of the IGFET 12 connected in series to the load 7 through which the constant current should flow, as illustrated in FIG. 2, the current $I_{ref7}$ flowing through the IGFET 12 and the load 7 will be expressed by the following equation.

$$I_{ref7} = \frac{K_{NO}}{2}(V_{GN} - V_{TN})^2 = \frac{K_{NO}}{2} C_1^2 (V_{TP1} - V_{TP2})^2 \quad (9)$$

In which, the assumption is made that the conductance constant of the IGFET 12 is $K_{NO}$ and the threshold voltage thereof is equal to $V_{TN}$ which is the same as that of the IGFETs 10 and 11.

Figure 3:
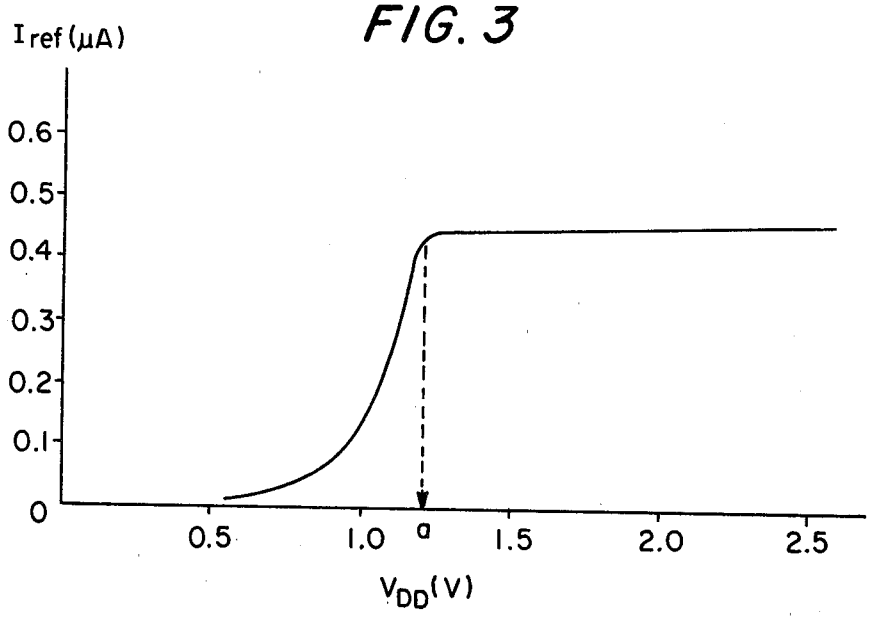
FIG. 3 is a graph for illustrating that a constant current value depends upon the power source voltage of the constant current circuit of the present invention.

As understood from the equation (9), the current $I_{ref7}$ flowing through the load 7 does not depend upon the voltage $V_{DD}$ of the power source 6 and the resistance value of the load 7. FIG. 3 illustrates a curve showing a dependency of $I_{ref7}$ for power source voltage $V_{DD}$. Since all of the IGFET are operated in a saturation region when the power source voltage $V_{DD}$ is more than 1.2 volts, the current $I_{ref}$ shown in FIG. 3 does not depend upon the power source voltage $V_{DD}$.

In order that each IGFET in the constant current circuit of FIG. 2 is operated in saturation region, the following condition should be satisfied.

$$V_{DD} > V_{TN} + \frac{1 + \sqrt{K_{P1}/K_N}}{1 - \sqrt{K_{P1}/K_{P2}}} \quad (10)$$

$$V_{DD} > V_l + \frac{\sqrt{K_{P1}/K_N}}{1 - \sqrt{K_{P1}/K_{P2}}} \quad (11)$$

wherein, $K_N = K_{N1} = K_{N2}$

In equation (11), $V_l$ represents a voltage across the load 7. As understood from the equations (10) and (11), the power source voltage $V_{DD}$=a shown in FIG. 3 is a saturation point of the constant current and the point can be determined in accordance with the selection of the conductance constant of each IGFET. When each conductance constant is determined in such a way that the value of each second term of the right side of equations (10) and (11), a constant current can be obtained by a low power source voltage. The saturating point of the constant current, that is, the power source voltage $V_{DD}$=a is also adjustable by changing each conductance constant even when $K_{N1}$ is not equal to $K_{N2}$. As understood from the equation (9), the current value of $I_{ref7}$ can be also controlled by the difference between the threshold levels of two IGFETs and the conductance constant of each IGFET. Especially, when it is controlled by the conductance constant $K_{NO}$ of the IGFET 12 connected in series to the load 7, $I_{ref7}$ can be controlled without the dependency of the saturation operation condition.

As described above, the usable power source voltage range and the constant current value of the constant current circuit of the present invention can be controlled by the conductance constant and the threshold voltage of each IGFET.

When the circuit shown in FIG. 2 is fabricated as an integrated circuit, the range of dispersion of the constant current $I_{ref}$ can be reduced to about 10(%). As clearly understood from the equation (9), the constant current value $I_{ref}$ is the multiplication of the constant determined by the conductance constant of each IGFET and the square of the difference between the threshold levels of two IGFETs. The less than 5% dispersion of the conductance constant can be obtained by the use of present integrated circuit fabfrication techniques. Also, the difference in threshold voltage between two IGFETs can be reduced to less than 5% by the use of the ion implantation technique. Although the consumption current of the constant current circuit is the sum of $I_1$ and $I_2$ represented by the equations (3) and (4), as understood from the equations (3) and (4), $I_1$ and $I_2$ can be reduced by adjusting the value of conductance constant. Therefore, the constant current circuit of the present invention is suitable for a circuit intended to reduce current consumption.

Figure 4:
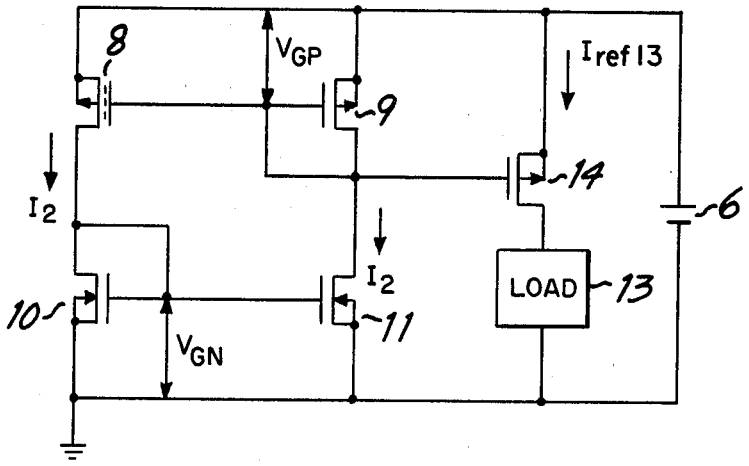

Although a N type IGFET is used as the constant current IGFET in the circuit of FIG. 2, a P type IGFET can be also used. FIG. 4 illustrates an example wherein a P type IGFET is used. This circuit is different from the circuit of FIG. 2 in that a series circuit of an IGFET 14 and a load 13 is connected in parallel to the power source 7 and the voltage $V_{GP}$ is applied to the gate electrode of the IGFET 14. When the conductance constant of the IGFET is represented by $K_{PO}$ and the threshold voltage is represented by $V_{TP2}$, the current $I_{ref13}$ flowing through the IGFET 14 and the load 13 is expressed as follows by the use of the equation (6).

$$I_{ref13} = \frac{K_{PO}}{2} C_2^2 (V_{TP1} - V_{TP2})^2 \quad (12)$$

As understood from the equation (12), the circuit of FIG. 4, as well as the circuit of FIG. 2, can produce the constant current $I_{ref13}$ with less current dispersion when it is fabricated as an integrated circuit.

Figure 5:
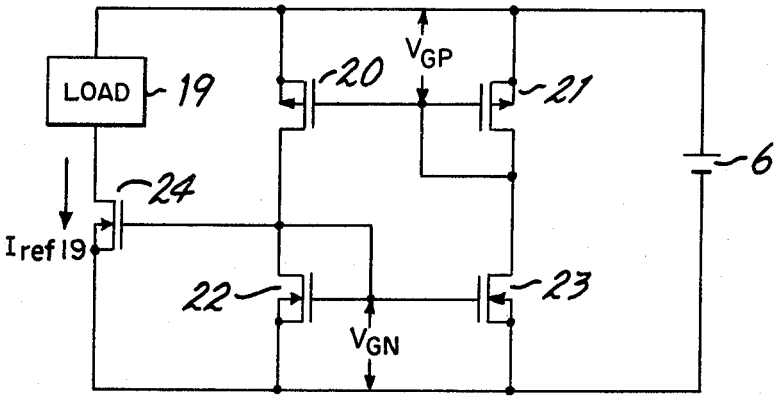
Figure 6:
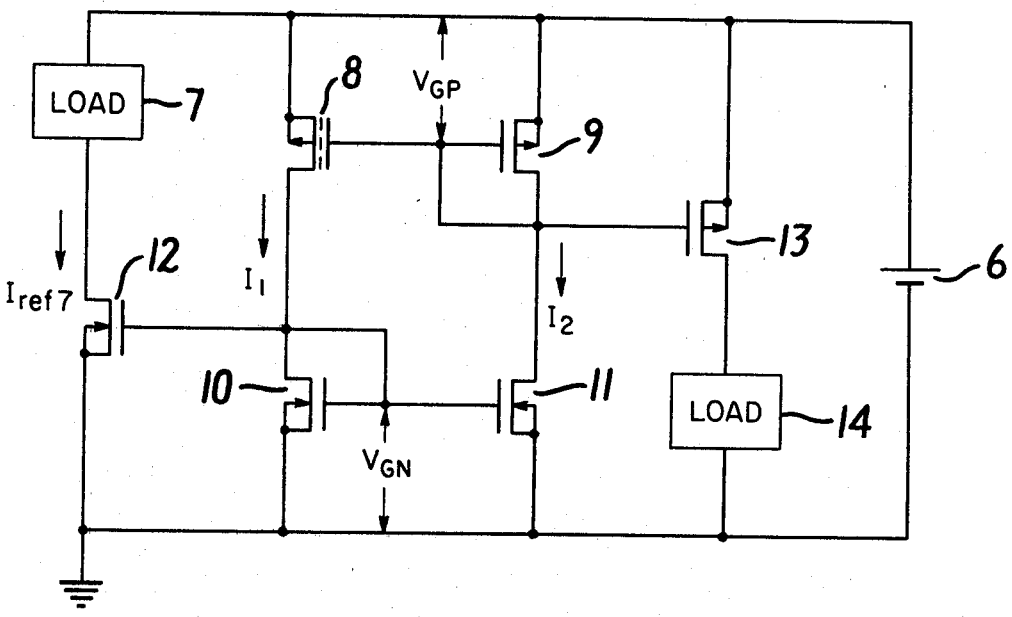

Although the circuits illustrated in FIG. 2 and FIG. 4 can produce a constant current with less current dispersion by utilizing the difference between two threshold voltages of P type IGFETs, the circuit of FIG. 5 is an example utilizing the difference in threshold voltage between two N type IGFETs. FIG. 6 illustrates another embodiment of the present invention wherein a pair of currents through respective load circuits 7 and 14 are maintained constant. In either case, as understood from the equations (9) and (12), the constant current $I_{ref}$ determined by the following equation can be obtained by the constant current circuit of the present invention.

$$I_{ref} = A(K)\Delta V^2 \quad (13)$$

A(K) is a constant determined by only the conductance constants of IGFETs included in the circuit, and $\Delta V$ is a difference in threshold voltage between the different two IGFETs. Although, to simplify the explanation, the discussion has been made for the case that all of the IGFETs are not operated in the sub-threshold region, the constant current value $I_{ref}$ produced by the constant current circuit of the present invention will also be determined by the equation (13), as long as they are operated in saturation region.

The effects of the present invention are as follows:

1. Since the circuit has no comparator and no constant voltage circuit, the circuit has simple structure and is suitable for reduction of the power consumption.

2. Since the constant current value is determined by the product of a constant determined by the conductance constant of the IGFET in the circuit and the difference in threshold level between two different IGFETs, the constant current can be obtained with less current dispersion by the use of the integrated circuit technique.

3. It is possible to reduce the circuit size since it is suitable for fabricating as an integrated circuit.

We claim:

1. A constant current circuit characterized in that a series circuit of a first insulated gate field effect transistor of a first conductivity type and a second insulated gate field effect transistor of a second conductivity type and another series circuit of a third insulated gate field effect transistor of the first conductivity type which is different in a threshold voltage from said first insulated gate field effect transistor and a fourth insulated gate field effect transistor of the second conductivity type which threshold voltage is equal to that of said second insulated gate field effect transistor are connected to a power source in parallel, respectively, gate electrodes of said first and third insulated gate field effect transistors are connected to a connecting point of said third and fourth insulated gate field effect transistors, gate electrodes of said second and fourth insulated gate field effect transistors are connected to a connection point of said first and second insulated gate field effect transistors to form a constant voltage circuit, a circuit in which a fifth insulated gate field effect transistor is connected to a load in series is connected to the power source in parallel, and a gate electrode of said fifth insulated gate field effect transistor is connected to a constant voltage output terminal.

2. A constant current circuit as claimed in claim 1 wherein said constant voltage output terminal is a connecting point of said first and second insulated gate field effect transistor, and the threshold voltage of said fifth insulated gate field effect transistor is equal to that of said second insulated gate field effect transistor and is the second conductivity type.

3. A constant current circuit as claimed in claim 1 wherein said constant voltage output terminal is a connecting point of said third and fourth insulated gate field effect transistors, and the threshold voltage of said fifth insulated gate field effect transistor is equal to that of said first insulated gate field effect transistor and is the first conductivity type.

4. A constant current circuit as claimed in claim 1 wherein said voltage constant output terminal is a connecting point of said third and fourth insulated gate field effect transistors, and the threshold voltage of said fifth insulated gate field effect transistor is equal to that of said third insulated gate field effect transistor and is the first conductivity type.

5. A constant current circuit as claimed in claim 2 wherein a circuit in which another load is connected to a sixth insulated gate field effect transistor in series is furthermore connected to said power source in parallel and a gate electrode of said sixth insulated gate field effect transistor is connected to the connecting point of said third and fourth insulated gate field effect transistors.

6. A constant current circuit as claimed in claim 5 wherein said sixth insulated gate field effect transistor is the first conductivity type and its threshold voltage is equal to that of said first insulated gate field effect transistor.

7. A constant current circuit as claimed in claim 5 wherein said sixth insulated gate field effect transistor is the first conductivity type and its threshold voltage is equal to that of said third insulated gate field effect transistor.

8. A constant current circuit, comprising:

a first insulated gate field effect transistor of a first conductivity type;

a second insulated gate field effect transistor of a second conductivity type connected in series with said first insulated gate field effect transistor;

a third insulated gate field effect transistor of the first conductivity type having a threshold voltage different from that of said first insulated gate field effect transistor;

a forth insulated gate field effect transistor of the second conductivity type connected in series with said third insulated gate field effect transistor and having a threshold voltage equal to that of said second insulated gate field effect transistor;

the series transistor pair of said first and second insulated gate field effect transistors being connected in parallel with the series transistor pair of said third and fourth insulated gate field effect transistor with said first and third insulated gate field effect transistors connected together and said second and fourth field effect transistors connected together;

first means for electrically connecting the respective gate electrodes of said first and third insulated gate field effect transistors to the node between said third and fourth insulated gate field effect transistors;

second means for electrically connecting the respective gate electrodes of said second and fourth insulated gate field effect transistor to the node between said first and second insulated gate field effect transistors; and a fifth insulated gate field effect transistor having a gate electrode connected to a respective one of said nodes so as to flow therethrough in operation a substantially constant current when a supply voltage is applied across the pair of parallel connected series transistor pairs and said fifth insulated gate field effect transistor is connected in parallel with the supply voltage.

* * * * *